US006932000B2

(12) United States Patent
Ruohola et al.

(10) Patent No.: US 6,932,000 B2
(45) Date of Patent: Aug. 23, 2005

(54) SYSTEM FOR FEEDING COMBUSTION AIR IN A SODA RECOVERY BOILER

(75) Inventors: Tuomo Ruohola, Tampere (FI); Jussi Mäntyniemi, Ylöjärvi (FI)

(73) Assignee: Kvaerner Power Oy, Tampere (FI)

( * ) Notice: Subject to any disclaimer, the term of this patent is extended or adjusted under 35 U.S.C. 154(b) by 0 days.

(21) Appl. No.: 10/682,840

(22) Filed: Oct. 10, 2003

(65) Prior Publication Data

US 2004/0221779 A1 Nov. 11, 2004

(30) Foreign Application Priority Data

Oct. 10, 2002 (FI) ..... 20021810

(51) Int. Cl.[7] ..... F23G 7/04; F23L 9/00
(52) U.S. Cl. ..... 110/238; 110/297
(58) Field of Search ..... 110/238, 297, 110/343, 345, 346, 348, 234, 347, 175, 176, 180

(56) References Cited

U.S. PATENT DOCUMENTS 5,007,354 A * 4/1991 Uppstu ..... 110/238
5,022,331 A 6/1991 Simonen
5,305,698 A 4/1994 Blackwell et al.
5,771,817 A 6/1998 Olausson et al.
6,302,039 B1 10/2001 MacCallum et al.
2002/0162491 A1 11/2002 Saviharju et al.

FOREIGN PATENT DOCUMENTS

CA 2245294 * 3/2000 ..... F23C/7/02
EP 0 761 871 A1 3/1997
WO WO 93/05228 A1 3/1993
WO WO 98/35185 A1 8/1998
WO 01/31119 5/2001
WO WO 03/042452 A1 5/2003

* cited by examiner

*Primary Examiner*—Kenneth Rinehart
(74) *Attorney, Agent, or Firm*—Venable LLP; Eric J. Franklin

(57) ABSTRACT

A method and a system for feeding combustion air of a soda recovery boiler to a furnace. The air is fed to the boiler furnace as primary air jets and auxiliary airjets, which are substantially shorter than the primary air jets. At least one primary airjet is placed between two opposite auxiliary air jets.

6 Claims, 2 Drawing Sheets

SYSTEM FOR FEEDING COMBUSTION AIR IN A SODA RECOVERY BOILER

FIELD OF THE INVENTION

The invention relates to a method for feeding combustion air in a soda recovery boiler The invention also relates to a system for feeding combustion air in a soda recovery boiler, as well as to a soda recovery boiler using the system for feeding combustion air.

BACKGROUND OF THE INVENTION

Spent liquor, or so-called black lye, is generated particularly in some manufacturing processes of the paper industry, such as pulping. The black lye is burnt in recovery boilers made for the processing of black lye, i.e. so-called soda recovery boilers, wherein energy, flue gases and chemicals used during the pulping are released from the black lye. The feeding of combustion air affects particularly the usability of the apparatus and the releases.

It is known to feed combustion air to different air feeding levels of the soda recovery boiler, i.e. so-called primary, secondary, tertiary and quaternary levels, wherein it is possible to control the combustion in the different parts of the boiler and thereby to achieve as complete a combustion as possible. In the feeding of combustion air, it has turned out to be problematic that the combustion air is typically not divided evenly on the whole air feeding level but various turbulences are developed in the boiler which prevent the appropriate combustion of the black lye.

To eliminate the problem, various systems have been developed for feeding combustion air. U.S. Pat. No. 5,305,698 discloses an arrangement, in which the combustion air is introduced into the furnace of the boiler from opposite edges in such a way that the air jets emitted from the opposite edges of the furnace are interlaced. A problem in such an arrangement is that the air jets either impinge on the opposite wall of the furnace or the air jets remain short. In the impact between the air jet and the wall, a turbulence area is developed which is harmful for the combustion process. If the air jets remain short, the combustion air is not mixed in a desired way with the substance to be combusted.

U.S. Pat. No. 5,305,698 also discloses an arrangement in which combustion air is introduced from opposite edges of the furnace of the boiler in such a way that short and long air jets are introduced alternately from the edges of the furnace, and the air jets emitted from the opposite edges of the furnace meet in such a way that a short air jet meets a long air jet coming from the opposite side (in other words, so-called partial interlacing of the air jets takes place). Typically, in such an arrangement, the air jets hit each other and a so-called droplet lift is developed in the impact area where the droplets of black lye are entrained in a strong upwards flue gas flow carrying said droplets to the upper part of the furnace. In this case, the combustion process in the boiler is distorted as the combustion is effected "in the wrong place" wherein, for example, the efficiency of the boiler is changed and the releases are increased.

SUMMARY OF THE INVENTION

It is a primary aim of the present invention to disclose an arrangement for feeding combustion air, whereby the combustion air can be fed into the furnace substantially evenly on the whole air feeding level.

To attain this purpose, the present invention includes the method, system for feeding combustion air, and boiler using the system for feeding combustion air described herein.

The aim of the invention is to feed the combustion air to the boiler furnace substantially evenly on the whole air feeding level. The combustion air is fed into the furnace from opposite edges of the furnace in such a way that both and short long air jets are fed from both edges of the furnace. The long air jets extend close to the opposite edge of the furnace, and the short air jets extend preferably less than half-way the distance between the opposite edges of the furnace. According to the invention, the long air jet extends close to the opposite edge, between two short air jets emitted from said opposite edge.

The opposite walls of the boiler furnace are equipped with nozzles for feeding combustion air. There are two different main types of nozzles: primary nozzles, which are used to produce an air jet extending far in the furnace, and auxiliary nozzles, whose air jets have a substantially short range. The nozzles are placed in the wall of the boiler in such a way that the auxiliary nozzles are placed on both sides of the primary nozzle, and two auxiliary nozzles are placed between two primary nozzles. The primary nozzle and the auxiliary nozzle may be formed of several nozzles, provided that they produce a jet which substantially corresponds to a jet emitted by a single nozzle.

The primary nozzles and the auxiliary nozzles to be placed on the same wall of the boiler furnace may be located at the same height or at different heights in the vertical direction. However, in view of the air jets, it is advantageous to place the nozzles substantially at the same height so that the auxiliary nozzles are slightly above the primary nozzles.

The nozzles to be placed on opposite walls may be placed either at the same height or at different heights in the vertical direction so that the nozzles are directed substantially towards the nozzles in the opposite wall in the furnace. By placing the nozzles of the opposite walls at slightly different heights, the air feeding level becomes slanted, which has, in some uses, an advantageous effect on the air and gas flows in the furnace.

The supply of combustion air according to the invention provides a uniform "flow mat" which covers substantially the whole air feeding level and in which the air jets are preferably turned upwards, which, in turn, has an advantageous effect on the mixing of the flue gas with air.

The supply of combustion air according to the invention can be used on different levels for feeding combustion air in the boiler, such as, for example, the primary, secondary, tertiary or quaternary levels.

BRIEF DESCRIPTION OF THE DRAWINGS

In the following, the invention will be described in more detail with reference to the appended principle drawings, in which.

DETAILED DESCRIPTION OF THE INVENTION

Figure 1:
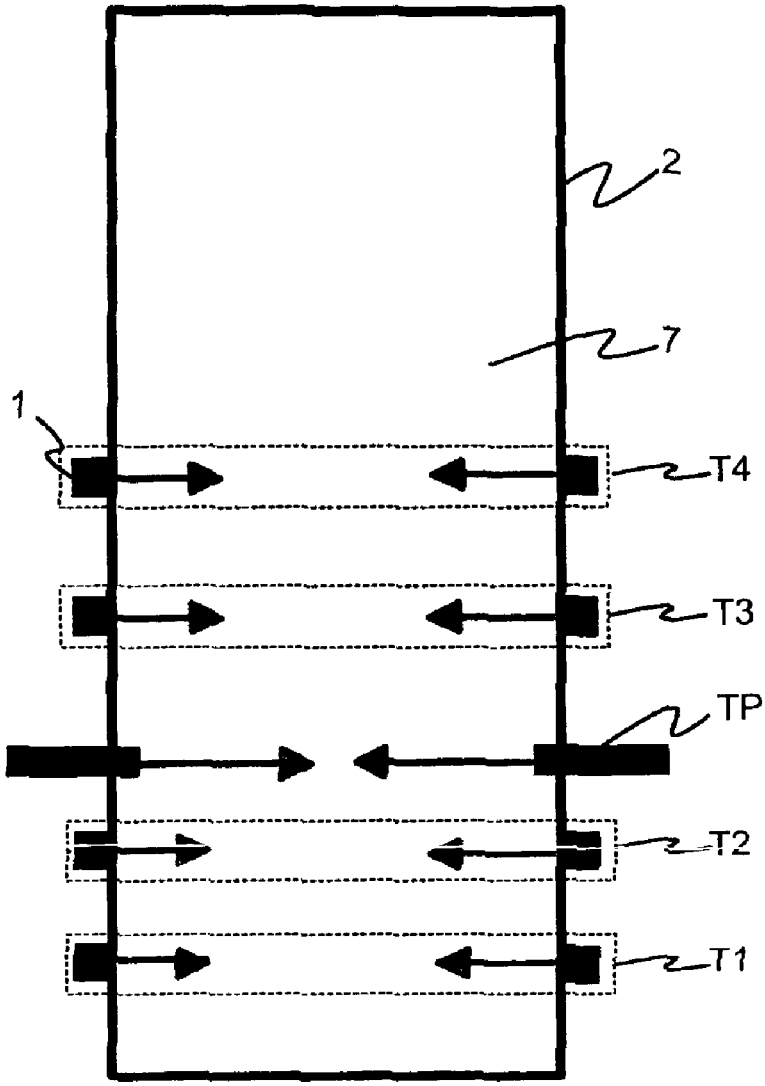
FIG. 1 shows a vertical cross-section of a soda recovery boiler.

FIG. 1 shows the typical structure of a soda recovery boiler. The soda recovery boiler is a tower-like construction whose furnace 7 is typically rectangular or square in the horizontal cross-section. The boiler comprises means TP which are suitable for feeding fuel, such as nozzles suitable for black lye, by means of which the substance to be burnt is fed into the furnace 7. The combustion air needed for the combustion is fed into the furnace 7 on different functional air feeding levels, such as primary T1, secondary T2, tertiary T3 and quaternary T4 levels shown in the figure. The functional air feeding level T1–T4 typically comprises 1 to 3 sublevels.

Figure 2:
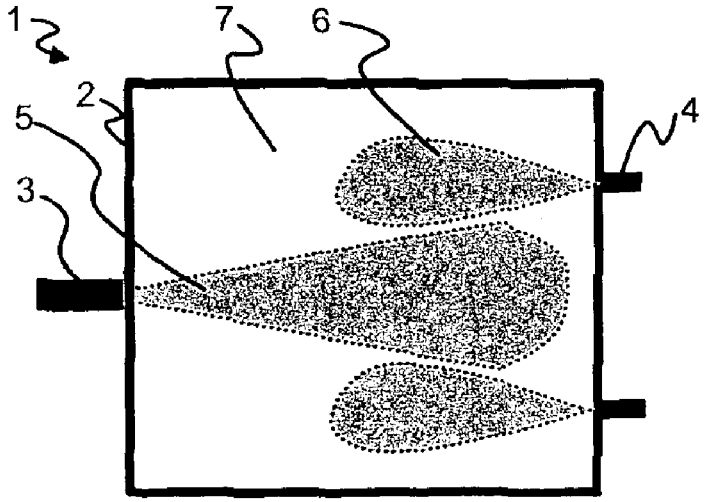
FIG. 2 shows a horizontal cross-section of the system for feeding combustion air according to one embodiment of the invention.

The system 1 for feeding combustion air according to the invention can be placed on any functional air feeding level T1–T4 or on any sublevel of the functional air feeding level. The following discussion of the invention will deal with one air feeding level or sublevel and an air feeding system 1 placed on the same. One of the simplest embodiments of the combustion air feeding system 1 according to the invention is shown in FIG. 2. Another embodiment of the feeding system 1 according to the invention is shown in FIG. 3, seen from above, and the same embodiment is shown in a side view in FIG. 4.

The opposite walls 2 of the furnace 7 are equipped with nozzles 3, 4 for feeding combustion air. There are two different main types of the nozzles: primary nozzles 3, which are used to produce an air jet 5 extending far in the furnace 7, and auxiliary nozzles 4, whose air jets 6 have a short range. The nozzles 3, 4 are placed on the wall 2 as shown in FIG. 3, wherein there are auxiliary nozzles 4 on both sides of the primary nozzle 3, and two auxiliary nozzles between two primary nozzles. It is also possible to form the primary nozzle 3 and the auxiliary nozzle 4 of several separate nozzles, provided that the jet 5, 6 produced by them substantially corresponds to a jet emitted by a single nozzle. In the following description of the invention, the primary 3 and auxiliary 4 nozzles will be discussed as if they were single nozzles, but in the spirit of the invention, said nozzles may also consist of several nozzles.

It is advantageous to place nozzles in opposite walls 2 of the furnace 7 in such a way that the number of primary nozzles 3 differs by one between the walls. For example, when there are two primary nozzles 3 in the first wall 2, it is advantageous to use one or three primary nozzles in the opposite wall. Said arrangement has been shown to have an advantageous effect on the mixing of air with flue gas in the furnace 7. Naturally, it will be obvious that the number of primary nozzles 3 and the primary air jets 5 produced by them may vary freely within the basic idea of the invention, and naturally it is possible to provide the air supply in such a way that there are no primary nozzles in one of the walls.

Figure 3:
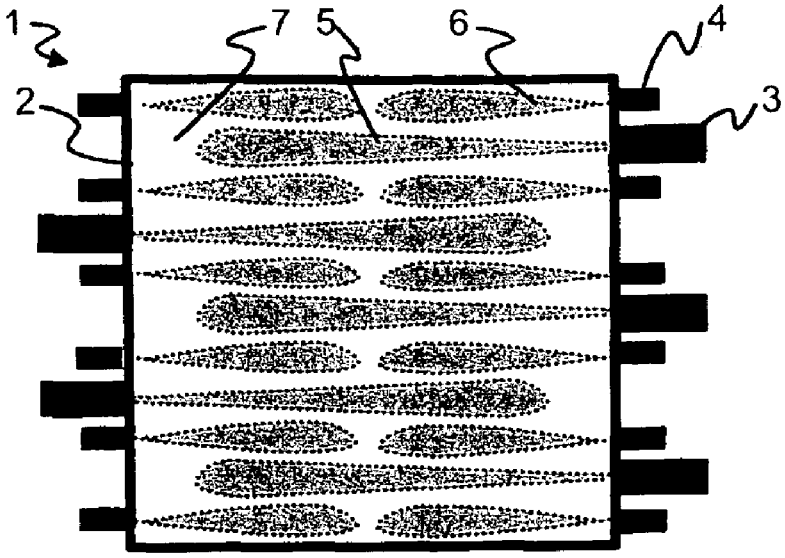
FIG. 3 shows the horizontal cross-section of a system for feeding combustion air according to another embodiment of the invention.
Figure 5:
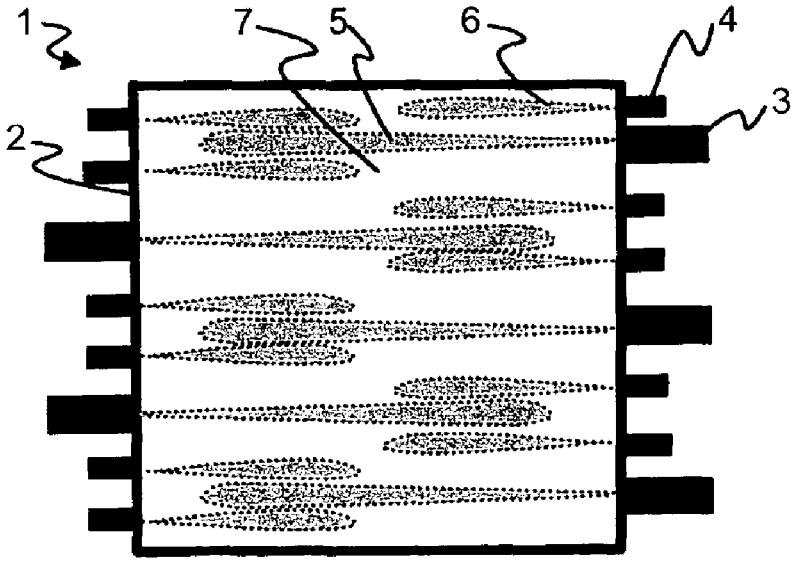
FIG. 5 shows the horizontal cross-section of the system for feeding combustion air according to a third embodiment of the invention.

The nozzles 3, 4 placed in opposite walls 2 are located horizontally so that the jet 5 of the primary nozzle 3 is placed substantially between the jets 6 from two adjacent auxiliary nozzles 4 in the opposite wall, as shown in FIG. 3. The auxiliary nozzles 4 of the opposite walls 2 may be placed as shown in FIG. 3 so that the jets 6 from the auxiliary nozzles are aligned. It is also possible to place the auxiliary nozzles 4 as shown in FIG. 5, wherein the jets 6 from the auxiliary nozzles are on different lines. The arrangement of FIG. 5 is advantageous when the number of primary nozzles 3 is relatively small.

Figure 4:
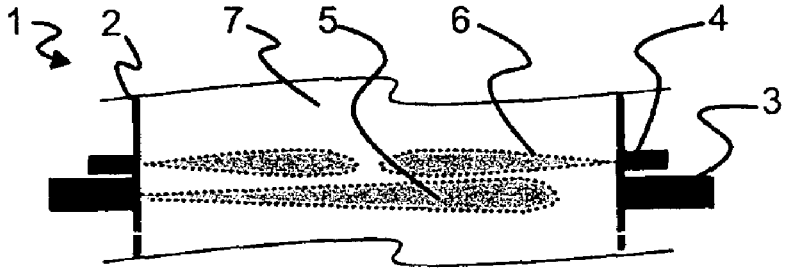
FIG. 4 shows the vertical cross-section of the system for feeding combustion air according to another embodiment of the invention.

The primary nozzles 3 and the auxiliary nozzles 4 placed in the same wall 2 can be in the same plane or in different planes in the vertical direction; however, it is advantageous to place the nozzles, as shown in FIG. 4, in substantially the same plane so that the auxiliary nozzles are slightly above the primary nozzles.

The nozzles 3, 4 placed in opposite walls 2 may be positioned either on the same level or on different levels in the vertical direction so that the nozzles are directed substantially towards the nozzles in the opposite wall. By placing the nozzles 3, 4 of the opposite walls 2 on slightly different levels, the blowing level can be made slanted, which has an advantageous effect in some uses.

Next, we shall describe the principle of operation of the above-presented system 1 for feeding combustion air.

The primary jet 5 supplied from the primary nozzle 3 is substantially stronger than the auxiliary jets 6 supplied from the auxiliary nozzles 4. The primary jet 5 penetrates the flue gas flowing vertically in the boiler furnace 7, towards the opposite wall 2. Close to the opposite wall 2, the primary jet 5 is positioned between two auxiliary jets 6 supplied from said opposite wall. The strength of the primary jet 5 is preferably such that the jet does not extend to the opposite wall 2, to avoid turbulences caused by the impingement of the jet on the wall. Preferably, the length of the primary jet 5 is about ¾ of the distance between the opposite walls 2. The strength of the auxiliary jets 6, which meet the sides of the opposite primary jet 5, is, in turn, preferably such that the jets do not extend to the area of influence of the opposite auxiliary jets, wherein no so-called droplet lift is developed in the furnace 7. Preferably, the length of the primary jets 6 is less than one half of the distance between the opposite walls 2.

When the sides of the primary jet 5 and the opposite auxiliary jet 6 meet, an area of turbulence is formed in said area. This phenomenon will make the mixing of air and flue gas more efficient as well as suppress the air jets 5, 6 in a desired manner, preventing the above-mentioned undesired impacts on other jets and/or walls 2. The primary jet 5 and the auxiliary jets 6 placed by its sides constitute a substantially uniform flow area penetrating the furnace 7. Consequently, parallel and opposite primary jets 5 and auxiliary jets 6 adjacent to each other, in turn, constitute a substantially uniform "flow mat" covering the furnace 7 in the horizontal direction. In the area of said flow mat, the flows of the jets 5, 6 turn preferably upwards when mixed with the flue gases, wherein the mixing of air with the flue gas becomes more efficient and said mixing takes place evenly in the area of the whole air feeding level.

The feeding of combustion air according to the invention can be used on different air feeding levels in the boiler, such as, for example, primary T1, secondary T2, tertiary T3 and quaternary T4 levels, as well as on other possible air feeding levels and their sublevels. The supply of the combustion air can be arranged on each different air feeding level uniformly with the other levels, or the supply of combustion air can be implemented on one or more air feeding levels in a mirror-like manner or in a direction transverse to the inputs of other air feeding levels.

Naturally, it will be obvious that the invention is not limited only to the embodiment presented in the preceding example, but the method for feeding combustion air in a boiler can also be used in boilers of other types than the soda recovery boiler given in the example, such as for example power boilers; particularly in fluidized bed boilers, said method for feeding air may be an advantageous arrangement.

By combining, in various ways, the operation modes and structures presented in connection with the different embodiments of the invention presented above, it is possible to produce various embodiments of the invention in accordance with the spirit of the invention. Therefore, the above-presented examples must not be interpreted as restrictive to the invention, but the embodiments of the invention can be freely varied within the scope of the inventive features presented in the claims hereinbelow.

What is claimed is:

1. A system for feeding combustion air in a soda recovery boiler, for feeding air into a furnace limited by vertical walls, the system comprising:

at least one primary nozzle to produce a primary air jet, and at least two auxiliary nozzles to produce auxiliary air jets smaller than the primary air jet, wherein at least one primary nozzle and two auxiliary nozzles are arranged in such a way that the primary air jet is placed between two auxiliary air jets, which auxiliary air jets are substantially opposite to the primary air jet, and wherein at least two auxiliary nozzles are arranged between two adjacent primary nozzles producing opposite primary air jets, and the auxiliary air jets of said at least two auxiliary nozzles are substantially opposite to each other.

2. A system for feeding combustion air in a soda recovery boiler, for feeding air into a furnace limited by vertical walls, the system comprising:

at least one primary nozzle to produce a primary air jet, and at least two auxiliary nozzles to produce auxiliary air jets smaller than the primary airjet, wherein at least one primary nozzle and two auxiliary nozzles are arranged in such a way that the primary air jet is placed between two auxiliary air jets, which auxiliary air jets are substantially opposite to the primary air jet, and wherein at least two auxiliary nozzles are placed between two adjacent primary nozzles producing primary air jets.

3. A system for feeding combustion air in a soda recovery boiler, for feeding air into a furnace limited by vertical walls, the system comprising:

at least one primary nozzle to produce a primary air jet, and at least two auxiliary nozzles to produce auxiliary air jets smaller than the primary air jet, wherein at least one primary nozzle and two auxiliary nozzles are arranged in such a way that the primary air jet is placed between two auxiliary air jets, which auxiliary air jets are substantially opposite to the primary air jet, and wherein the primary nozzles and the auxiliary nozzles are placed substantially on the same horizontal level.

4. A system for feeding combustion air in a soda recovery boiler, for feeding air into a furnace limited by vertical walls, the system comprising:

at least one primary nozzle to produce a primary air jet, and at least two auxiliary nozzles to produce auxiliary air jets smaller than the primary air jet, wherein at least one primary nozzle and two auxiliary nozzles are arranged in such a way that the primary air jet is placed between two auxiliary air jets, which auxiliary air jets are substantially opposite to the primary air jet, and wherein the auxiliary nozzles are placed above the primary nozzles.

5. A soda recovery boiler, comprising:

a system for feeding combustion air comprising at least one primary nozzle to produce a primary air jet, and at least two auxiliary nozzles to produce auxiliary air jets smaller than the primary air jet, wherein at least one primary nozzle and two auxiliary nozzles are arranged in such a way that the primary air jet is placed between two auxiliary air jets, which auxiliary air jets are substantially opposite to the primary airjet; and an air feeding level or a sublevel for an air feeding level, for feeding air into the boiler, wherein the system for feeding combustion air is placed on at least one of the following air feeding levels or their sublevels: primary level, secondary level, tertiary level, quaternary level.

6. A soda recovery boiler, comprising:

a system for feeding combustion air comprising at least one primary nozzle to produce a primary air jet, and at least two auxiliary nozzles to produce auxiliary air jets smaller than the primary air jet, wherein at least one primary nozzle and two auxiliary nozzles are arranged in such a way that the primary air jet is placed between two auxiliary airjets, which auxiliary air jets are substantially opposite to the primary air jet; and an air feeding level or a sublevel for an air feeding level, for feeding air into the boiler, wherein the system for feeding combustion air is placed on two or more of the following air feeding levels or their sublevels: primary level, secondary level, tertiary level, quaternary level.

* * * * *